US007325619B2

(12) United States Patent
Morrison

(10) Patent No.: US 7,325,619 B2
(45) Date of Patent: Feb. 5, 2008

(54) SUCKER ROD GUIDE INSTALLER

(76) Inventor: Bill Morrison, 212 Oriole Dr., Spearfish, SD (US) 57783

( * ) Notice: Subject to any disclaimer, the term of this patent is extended or adjusted under 35 U.S.C. 154(b) by 332 days.

(21) Appl. No.: 11/148,818

(22) Filed: Jun. 8, 2005

(65) Prior Publication Data

US 2006/0137885 A1 Jun. 29, 2006

Related U.S. Application Data

(60) Provisional application No. 60/638,842, filed on Dec. 23, 2004.

(51) Int. Cl.
*E21B 17/10* (2006.01)

(52) U.S. Cl. ..... 166/380; 166/241.4

(58) Field of Classification Search ..... None
See application file for complete search history.

(56) References Cited

U.S. PATENT DOCUMENTS

| | | | | |
|---|---|---|---|---|
| 4,668,117 | A | 5/1987 | Bair | |
| 4,858,688 | A | 8/1989 | Edwards et al. | |
| 5,282,302 | A | 2/1994 | Starks et al. | |
| 5,394,940 | A | 3/1995 | Durham | |
| 5,430,919 | A * | 7/1995 | Starks et al. | 29/252 |
| 6,729,391 | B2 * | 5/2004 | Hill et al. | 166/68.5 |

* cited by examiner

*Primary Examiner*—Frank Tsay
(74) *Attorney, Agent, or Firm*—Stephen M. Nipper; Dykas, Shaver & Nipper, LLP

(57) ABSTRACT

A sucker rod guide installation device for installing a sucker rod guide on a sucker rod. The device having a rod positioner for positioning the sucker rod and guiding a portion of the sucker rod into the sucker rod guide. The sucker rod guide held in a holder, the holder having at least one releasable attachment for holding the sucker rod guide attached to the sucker rod guide holder during the installation process. Various safety devices are also provided.

24 Claims, 5 Drawing Sheets

SUCKER ROD GUIDE INSTALLER

PRIORITY

This application is a non-provisional application which claims the priority date from the provisional application entitled SUCKER ROD GUIDE INSTALLER filed by Bill Morrison on Dec. 23, 2004 with application Ser. No. 60/638,842, the disclosure of which is incorporated herein by reference.

DESCRIPTION

BACKGROUND OF THE INVENTION

1. Field of the Invention

The present invention generally relates to production equipment for oil wells and more particularly, to a device and method for installing sucker rod guides in a spaced pattern along a string of sucker rods of a pumping well.

2. Background Information

At a wellhead, sucker rods are high tensile strength rods that make up the mechanical assembly between the surface and downhole components of a pumping system. The wellhead is the top end of the well where the oil is extracted from the well. The wellhead as defined herein is the control equipment fitted to the top of the well consisting of outlets, valves, blowout preventors, etc. Sucker rods are typically steel rods between 25 and 40 feet long. They are frequently threaded at each end to enable easy interconnection of individual segments of sucker rods as well as the downhole components. Sucker rods are commonly used for removing oil, methane, and other liquids and hydrocarbons.

Sucker rods are expensive and need to be treated with care so that they do not break during pumping or when positioned in a hole. If a sucker rod does break because of poor treatment or unfavorable hole conditions, it is sometimes impossible or extremely difficult to retrieve the sucker rod and attached components. This expense costs the industry millions of dollars a year.

As a result, sucker rods are often provided with sucker rod guides that are designed to prolong the useful life of the sucker rods and prevent damage thereto. A sucker rod guide typically comprises a rubber or plastic body which is configured for forcibly attachment to a sucker rod. Sucker rod guides are frequently used because they are a cheap way to prevent and/or lessen metal on metal wear and damage caused by poor hole conditions. Depending on the hole conditions, sucker rod guides may be installed at various, regular intervals along the chain of interconnected sucker rods so as to effectively protect the sucker rods from damage.

A typical sucker rod guide has a cylindrical shape, having an inner opening and hollow core defined therein. The opening allowing the sucker rod to inserted therethrough and into the hollow core. This core approximately the size of the sucker rod's exterior diameter, thereby allowing the guide to be snapped onto the sucker rod and held thereon.

One typical method of installation of such a sucker rod guide onto a sucker rod would involve the process of, in the field, hammering them onto the sucker rod with multiple blows. This technique has various disadvantages including: damage to the sucker rod during installation (sometimes invalidating the sucker rod warranty), physical injury caused by the sucker rod guide flying off the sucker rod, worker fatigue, the process is generally slow, and physical harm to equipment that may occur from the hammering/ricochet action.

As a result, there is a need in the art for a system and method that provides a quick and effective way to safely mount sucker rod guides on a sucker rod in the field and elsewhere.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a sucker rod guide installation device for installing a sucker rod guide on a sucker rod. The one embodiment of the device comprises a rod positioner and a sucker rod guide holder. The rod positioner for positioning the sucker rod. The rod positioner comprising a rod guide for guiding a portion of the rod into the sucker rod guide. The sucker rod guide holder for holding the sucker rod guide while the rod positioner guides the sucker rod portion therein. The sucker rod guide holder comprising at least one releasable attachment for holding the sucker rod guide attached to the sucker rod guide holder during the installation process.

It is preferred that the rod positioner further comprise a pair of opposing, spaced, generally parallel flanges, these flanges cooperating to guide the sucker rod into said sucker rod guide. The flanges spaced apart wider than the axial length of the sucker rod guide so that the sucker rod guide can be received between the flanges as said sucker rod is inserted into (and snaps within) the sucker rod guide.

It is further preferred that at least one releasable attachment be provided for allowing the use of various sizes of sucker rod guides therein. The preferred releasable attachment comprising at least one adjustable protrusion able to be adjusted based upon the size of the sucker rod guide thereby allowing various sizes of sucker rod guide to be used with the present invention. More particularly, the adjustable protrusion comprising a plurality of spring-loaded fasteners that both hold the sucker rod guide and allow the sucker rod guide to be released from the sucker rod guide holder when the sucker rod guide is forcibly attached to the sucker rod.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
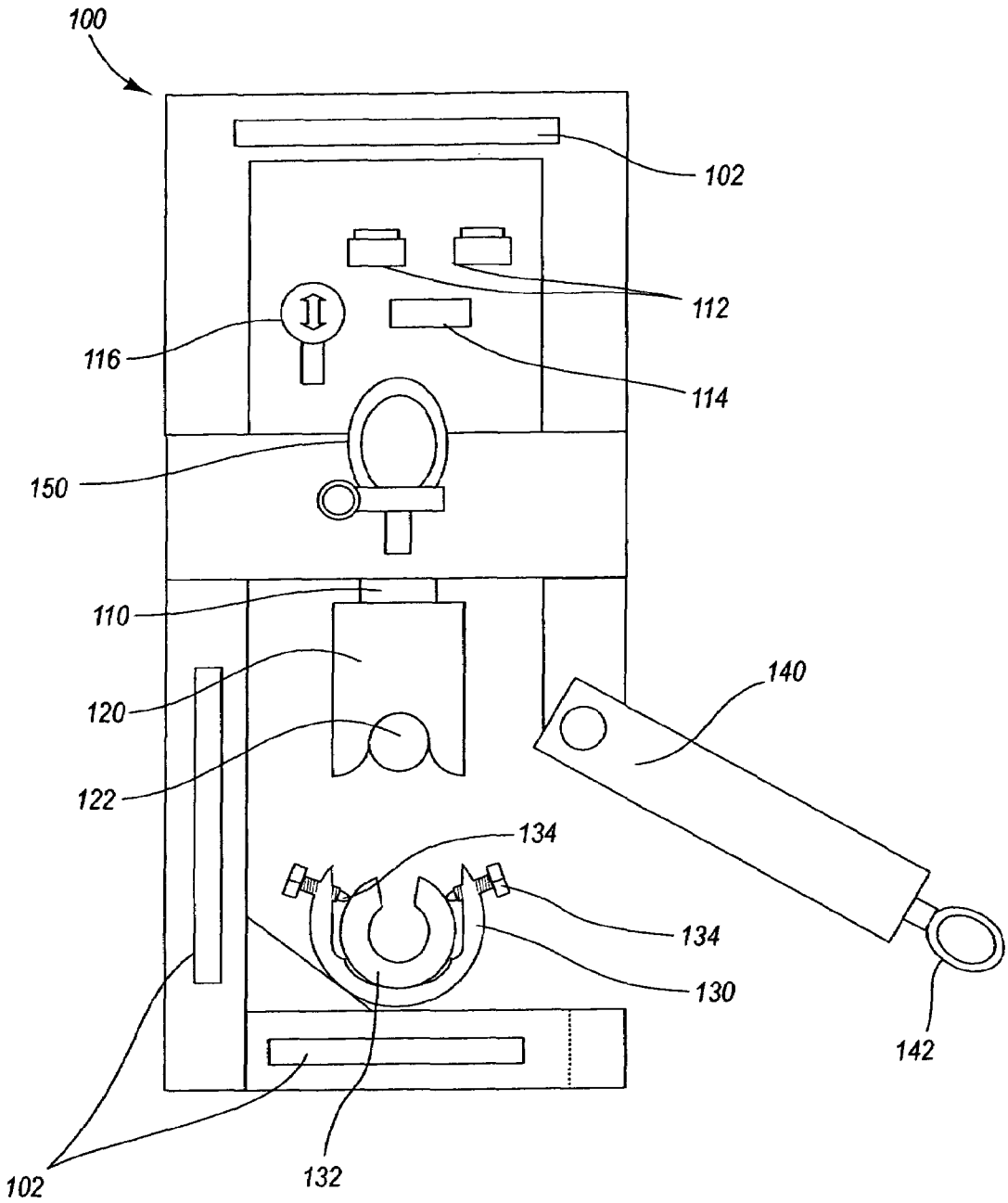
FIG. 1 is a top view of a preferred embodiment of the sucker rod guide installer with the safety arm open.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The accompanying drawings illustrate various embodiments of the present invention and are a part of the specification. Together with the following description, the drawings demonstrate and explain the principles of the present invention. The illustrated embodiments are examples of the present invention and do not limit the scope of the invention. Throughout the drawings, identical reference numbers designate similar, but not necessarily identical, elements.

The sucker rod guide installer 100 of the present invention provides a safe, convenient and efficient way to attach sucker rod guides 132 to a sucker rod 122 while in the field or at a off-site location. The present invention 100 allows for the increased movement and adaptability of installing sucker rod guides 132 as needed on sucker rods 122. The present invention is also adjustable, thereby allowing various sizes of sucker rod guides 132 to be mounted on the varying sucker rod 122 diameters.

FIG. 1 is a top view of a first embodiment of the sucker rod guide installer 100, shown with the safety arm 140 open. The present invention is configured for preferred use at the actual wellhead site. As such, the sucker rod guide installer 100 may be used in the field as the sucker rod 122 is being lowered into the hole. The sucker rod guide installer 100 is designed to be used at a site or wellhead using the conventional items available on most standard field trucks. It is also envisioned that the present invention may be used off-site, for instance it may be more practical to use the sucker rod guide installer 100 to install the guides in a workshop for purposes of efficiency and protection during transfer.

The preferred embodiment of the sucker rod guide installer 100 is equipped with hydraulic ports 112 for connection to a hydraulic system used to power the sucker rod guide installer 100. Most field trucks and on-site generators are equipped with the appropriate hydraulic lines/ports capable of powering the sucker rod guide installer 100.

This embodiment further showing a clevis 150 or similar attachment device configured for allowing the guide installer 100 to be swung in and out of position as the sucker rod 122 is being lowered into the hole from the rig or other lifting devices on site. The clevis 150 further allows the installer 100 to be moved between installations facilitating ease of use and convenience. Preferably, multiple handles 102 may be built into and/or attached to the frame of the guide installer 100 thereby allowing a user to move and position the installer 100 as needed. The handles 102 can also be used to lift the installer 100 for movement from one location or job site to another. The clevis 150 and handles 102 allow a user to easily move the guide installer 100 so that when the sucker rod and downhole components are being lowered into a hole the installer 100 does not physically interfere with the work being done.

The sucker rod guide installer 100 is preferably equipped with a safety arm 140 that can be opened to allow the sucker rod 122 to pass into the installer 100. Once the rod 122 is within the frame of the installer 100, the safety arm 140 can be swung closed and a latch 142 used to fasten the safety arm 140 so that the installer 100 cannot accidentally swing out of position while guides 132 are being installed. In the event that a sucker rod guide 132 breaks or the guide installer 100 is inadvertently moved, the safety arm 140 protects those using the guide installer 100 from injury.

The sucker rod 122 may be positioned adjacent to rod cradle 120 or "rod positioner." The rod cradle 120 is preferably molded from a single piece of material. The material is preferably aluminum or some other material that is softer than the rod and stronger than the rod guide. This means that any inadvertent contact between the cradle 120 and the rod 122 should not cause damage to the rod 122. During contact, the rod cradle 120 and surrounding parts of the guide installer 100 will thus deform before the sucker rod will, thereby protecting the rod.

In the embodiment shown, the cradle 120 is shaped in a rounded V-shape at the top and bottom. The top and bottom V-shapes are interconnected vertically to form the cradle 120 so that it abuts and generally cradles the rod when positioned against the cradle 130. The V-shape helps maintain contact between the rod 122 and the rod cradle 120 and helps to automatically position the rod 122 for easily attaching the rod guide 132.

In this embodiment, the rod cradle 120 is affixed to a hydraulic ram 110. The ram 110 is hydraulically powered by the ports 112 as previously described. While it is preferred that a hydraulic ram be used, obviously other manners of mechanically forcing the rod within the guide are likewise envisioned, including but not limited to other mechanical and electrical means.

A direction selector 116 allows the ram 110 to be moved forward or back as selected by the user. The directional selector 116 is spring biased to remain in a neutral position and preferably includes a notch for the neutral position. The directional selector 116 and the notch ensure that inadvertent contact with the directional selector 116 will not engage the ram 110 further ensuring the safety of the user.

A guide cradle 130 is used to temporarily hold the rod guide 132 until installed on the sucker rod 122. The preferred guide cradle 130 has multiple spring-loaded fasteners 134 threadably attached through the guide cradle body. These spring-loaded fasteners 134 allow the guide cradle 130 to hold various sizes of guides 132. In one embodiment, the spring-loaded fasteners 134 may be easily screwed in or out to allow multiple sizes of rod guides 132 to be positioned within the guide cradle 130. In another embodiment, the spring-loaded fasteners 134 may be slid in and out to adjust to a guide size. Other manners likewise are usable. The rod guide 132 is positioned within the guide cradle 130 with the open end or channel facing the positioned rod 122 and the corresponding rod cradle 120 (awaiting receipt therein of the rod). The guide cradle 130 is also preferably shaped so that the guide 132 is abutted on the non-open end.

Figure 2:
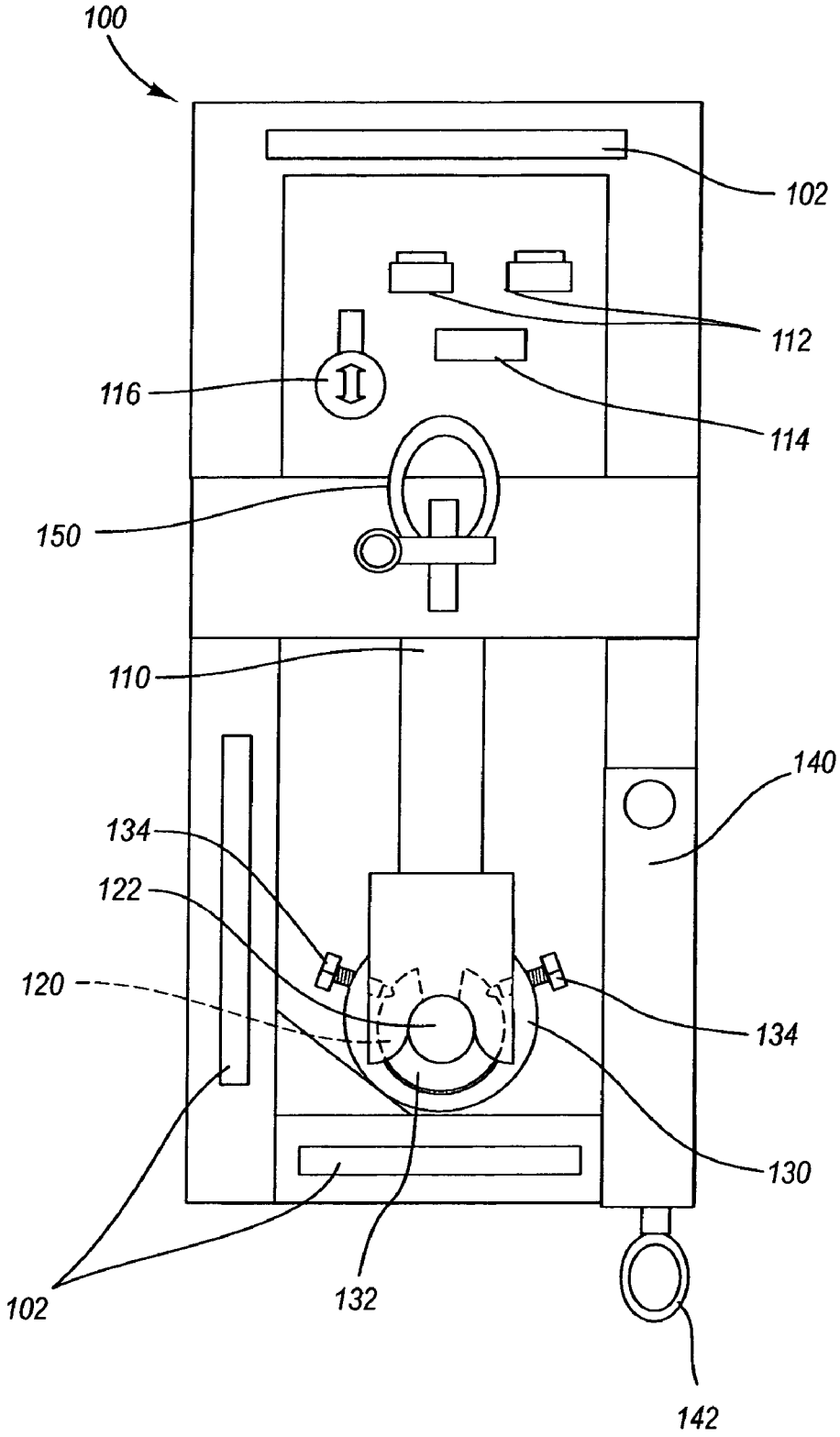
FIG. 2 is a top view of the sucker rod guide installer of FIG. 1, showing the safety arm in the installation position; the hydraulic ram extended thereby pushing the sucker rod into the sucker rod guide.

Referring now to FIG. 2, shown is a top view of the sucker rod guide installer 100 showing the hydraulic ram 110 extended thereby forcing the a sucker rod 122 (positioned against the rod cradle 120) into the sucker rod guide 132. The sucker rod guide being secured in the guide cradle 130. In FIG. 2, the sucker rod guide installer 100 is shown with the safety arm 140 closed and secured with the latch 142.

The multiple spring-loaded fasteners 134 have springing tips 136 that are used initially (as shown in FIG. 1) to secure the rod guide 132 when pressed normally to the guide cradle 130 or slipped into position from above. Once the sucker rod 122 has been pressed into the guide 132 (as shown in FIG. 2), the springing tips 136 allow the entire rod 122 and secured guide 132 to spring free from the guide cradle 130. Once the rod 122 and guide 132 are removed from the guide cradle 130 and the sucker rod 122 is lowered further into the well another rod guide 132 may be inserted into the guide cradle 130 for installation on the sucker rod 122.

Figure 3:
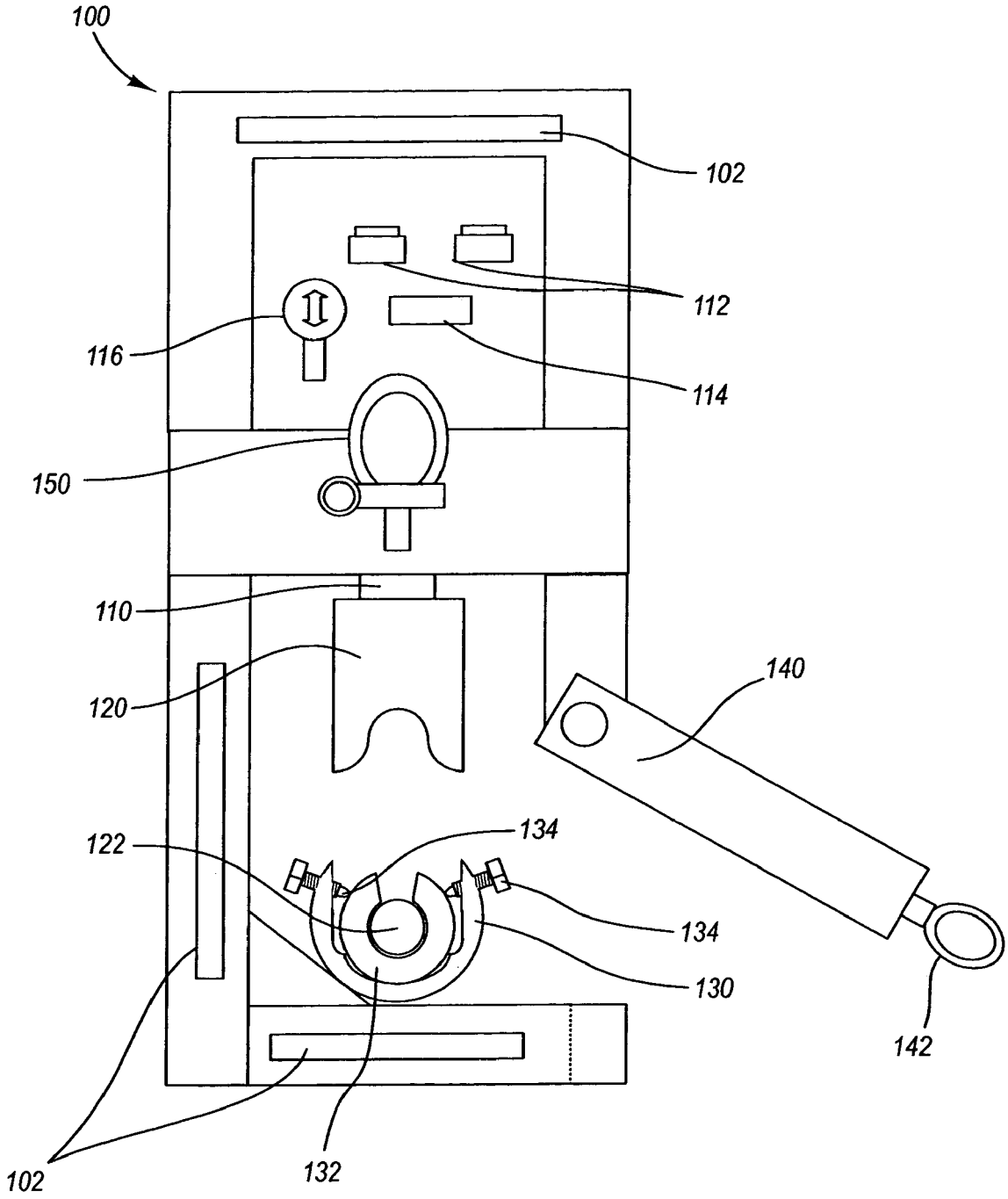
FIG. 3 is a top view of the sucker rod guide installer of FIG. 1, showing the hydraulic arm retracted leaving the sucker rod within the sucker rod guide

Referring now to FIG. 3, shown is a top view of the sucker rod guide installer 100 showing the hydraulic ram 110 retracted, leaving the sucker rod 122 inserted within the sucker rod guide 132.

Once a user is done using with the sucker rod guide installer 100, the latch 142 can be released and the safety arm 140 opened to be moved or repositioned. Because the rod guide 132 does not have to be physically removed from the guide cradle 132, installation of the rod guides 132 is much more efficient. In another embodiment, the guide cradle and the rod cradle may be interchanged so that the guide cradle is driven by the ram towards the sucker rod and rod cradle.

The sucker rod guide installer 100 is also preferably equipped with a pressure gauge 114 to verify that the proper hydraulic pressure is maintained when using the ram 110. Additionally, the gauge 114 allows a user to see what pressure pounds per square inch is required to mount a rod guide 132 and may give some indication as to the when the guide 132 will snap into position and what type of condition the rod guide 132 is in.

Figure 4:
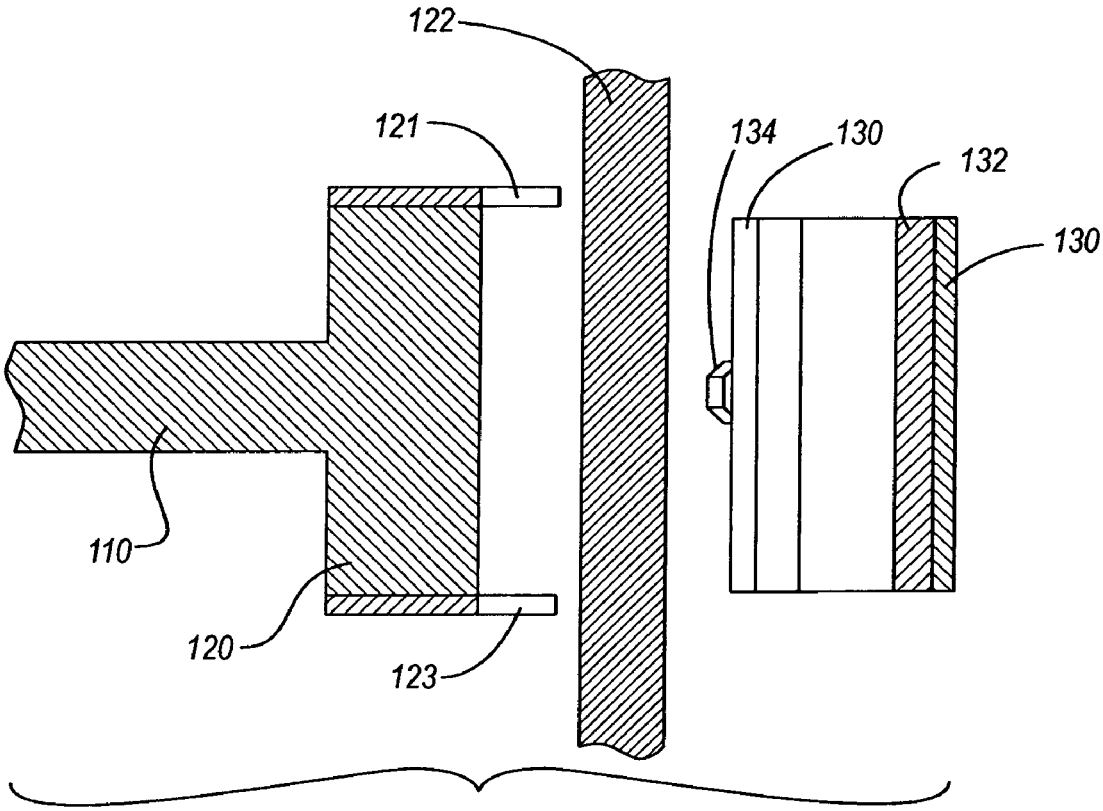
FIG. 4 is a partial, side, cross-sectional view of a second embodiment of the present invention.

Referring now to FIG. 4, shown is another embodiment (partially) of the present invention. This embodiment showing the hydraulic ram 110 attaching to the rod cradle 120. The rod cradle 120 having a top cradle flange 121 and a bottom cradle flange 123, these flanges providing the rounded V-shaped cradle previously mentioned. Other shapes, including but not limited to U-shapes, are likewise envisioned. These flanges 121, 123 preferably spaced apart further than the sucker rod guide 132 is tall (as shown in FIG. 4) so that the top flange 121 can press a first portion of the rod 122 into the guide 132, and the bottom flange 123 can press a second portion of the rod 122 into the guide 132. By pressing the rod 122 at least two positions into the guide 132, the present invention works better.

In one example of a preferred use of the present invention, the sucker rod guide installer 100 is positioned in the field above the wellhead. The spring-loaded fasteners 134 are adjusted to hold the size of rod guides 132 that will be used on the sucker rod 122. As the sucker rod 122 is lowered into the well, a user select portions of the sucker rod 122 that they would like to install rod guides 132 upon. A rod guide 132 is inserted into the cradle 130 by pushing it normal to the cradle 130 until the spring loaded fasteners 132 accept it or by sliding it into the cradle 130 from above wherein it is held by the spring loaded fasteners 132, and more particularly the springing tips 136.

At that point, the safety arm 140 is opened to accept the sucker rod 122. The safety arm 140 is then secured by the latch 142. The guide installer 100 is positioned so that the rod 122 fits within the rod cradle 120. Once the user is assured that the rod guide 132 can be safely mounted, he uses the directional lever 116 to activate the hydraulic ram 110 wherein the sucker rod 122 is pushed against the rod guide 132 until it snaps onto the sucker rod 122.

The rod 122 and attached rod guide 132 may be removed from the guide cradle 130 by simply pulling it past the springing tips 136 of the spring loaded fastener 134. At this point, the safety arm 140 may be opened in order to move or reposition the guide installer 100 or the sucker rod 122 may be further lowered and another rod guide 132 may be inserted into the rod cradle 130 for installation. These steps may be repeated as many times as necessary to adequately protect the interconnected sucker rod chain with adequate rod guides 132.

Figure 5:
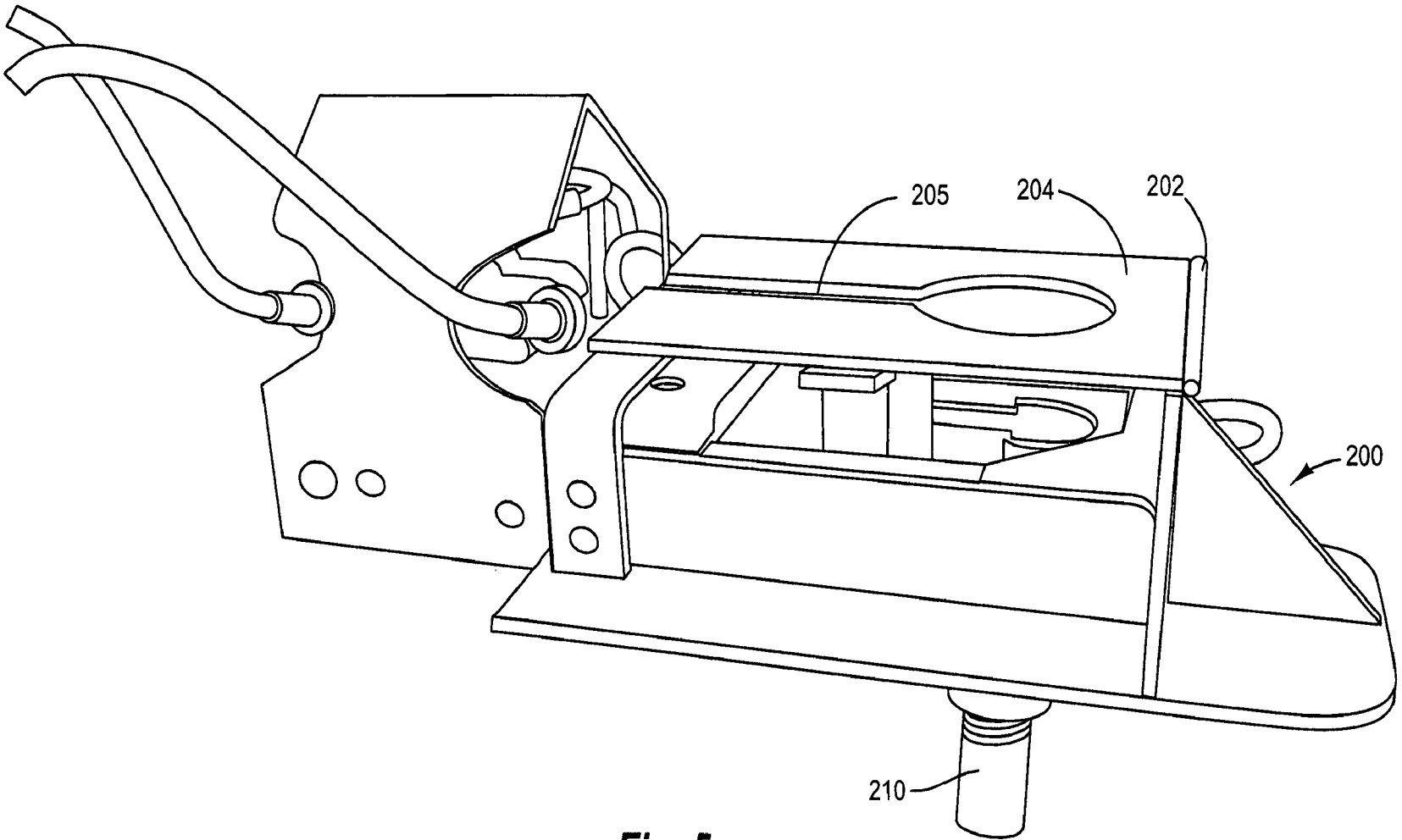
FIG. 5. is a perspective view of a third embodiment of the present invention.

In a second embodiment (shown in FIG. 5), the sucker rod guide installer 200 includes a wellhead attachment 210. The wellhead attachment 210 allows the sucker rod guide installer 200 to attach directly to the wellhead for ease of use. Most wellheads include a threaded fitting for attaching caps and other necessary elements directly to the wellhead. Preferably, the sucker rod guide installer 200 and corresponding wellhead attachment 210 can be threadably attached to the wellhead.

The wellhead attachment 210 is preferably designed so that it may be slidably secured within the frame of the guide installer and then bolted or otherwise attached to further secure it. Once attached to the frame, the sucker rod guide installer 200 can be mounted to a wellhead in order to more safely and efficiently attach rod guides.

The sucker rod guide installer 200 preferably includes a hinged cover plate 204. The hinged cover plate 204 defines a slit 205 which allows the sucker rod to be moved back and forth as the hydraulic ram is engaged to snap on rod guides. The slit is preferably rounded at the point where it is directly over the wellhead allowing the sucker rod and attached elements to be moved as needed. The hinged cover plate 204 is hinged 202 in order to allow the cover plate 204 to be pivoted out of the way as needed. For example, if a user is having difficulty accessing the guide cradle he may simply pivot the hinged cover plate up and away from the guide cradle and rod cradle. Once the rod guide is positioned, the hinged cover plate may be pivoted back down with the sucker rod positioned within the slit.

The hinged cover plate 204 serves various other functions. It further protects a user if a rod guide should break or slip during installation. Additionally, an elevator is used to connect multiple sucker rods together. The elevator prevents the sucker rod and downhole components from slipping and falling down the hole as multiple sucker rods are connected to each other. The hinged cover plate 204 is preferably supported by the frame of the sucker rod guide installer 200 and frame of the wellhead attachment 210. The elevator and downhole components including the sucker rod can be supported on the hinged cover plate as another sucker rod is moved into place and connected to the downhole sucker rod. This application allows the sucker rod guide installer to further increase the timely connection of sucker rods and rod guides while simultaneously preventing the downhole elements from falling down the well. The hinged cover plate can also be used to rest tools as needed. In another embodiment, the hinged cover plate is directly connected to the guide installer.

In one embodiment of the sucker rod guide installer and wellhead attachment, a short nipple is placed into the wellhead. At that point the sucker rod guide installer is placed over the nipple. The wellhead attachment portion of the guide installer includes a union or collar that threadably attaches to the nipple. Once secured, the sucker rod guide installer may be used to attach multiple guides as often as necessary. The sucker rod guide installer may include a base stand that can be fixably attached to the sucker rod guide installer to support those elements that are not approximately above the wellbore. The base stand may be used to reduce the torque and possible damage on the wellhead when the guide installer is mounted thereon.

In another preferred embodiment, those elements described as part of the wellhead attachment are an integrated part of the rod guide installer. The rod guide installer may also be built in a configuration so it may install multiple rod guides at once. Such installation is preferably done with a sucker rod positioned horizontally on a table wherein the multiple rod guide installer is mounted or positioned. This would allow the rod guides to be installed before going into the field. This would further protect the sucker rods and allow the sucker rod string to be more efficiently assembled in the field.

The preceding description has been presented only to illustrate and describe embodiments of invention. It is not intended to be exhaustive or to limit the invention to any precise form disclosed. Many modifications and variations are possible in light of the above teaching.

The foregoing embodiments were chosen and described in order to illustrate principles of the invention and some practical applications. The preceding description enables others skilled in the art to utilize the invention in various embodiments and with various modifications as are suited to the particular use contemplated. It is intended that the scope of the invention be defined by the following claims.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A sucker rod guide installation device for installing a sucker rod guide on a sucker rod, said device comprising:

a rod positioner for positioning said sucker rod, said rod positioner comprising a rod positioner rod guide for guiding a portion of said rod into said sucker rod guide; and a sucker rod guide holder, said sucker rod guide holder for holding said sucker rod guide while said rod positioner guides said sucker rod portion therein, said sucker rod guide holder comprising at least one releasable attachment for holding said sucker rod guide attached to said sucker rod guide holder during the installation process, wherein said at least one releasable attachment is adjustable for allowing the use of various sizes of sucker rod guides therein.

2. The sucker rod guide installation device of claim 1, wherein said rod positioner further comprises a pair of opposing, spaced, generally parallel flanges, said flanges cooperating to guide said sucker rod into said sucker rod guide.

3. The sucker rod guide installation device of claim 2, wherein said flanges are spaced apart wider than the axial length of said sucker rod guide so that the sucker rod guide can be received between said flanges as said sucker rod is inserted into said sucker rod guide.

4. The sucker rod guide installation device of claim 1, wherein said at least one releasable attachment comprises at least one adjustable protrusion able to be adjusted based upon the size of the sucker rod guide.

5. The sucker rod guide installation device of claim 4, wherein said adjustable protrusion comprises a plurality of spring-loaded fasteners that both hold said sucker rod guide and allow said sucker rod guide to be released from said sucker rod guide holder when said sucker rod guide is forcibly attached to said sucker rod.

6. The sucker rod guide installation device of claim 1, wherein said rod positioner further comprises a hydraulic ram for driving said sucker rod into said sucker rod guide.

7. The sucker rod guide installation device claim 6, wherein said device further comprises a pressure gauge for monitoring hydraulic pressure exerted by said hydraulic ram, said monitored hydraulic pressure providing feedback to a user as to the force necessary to install said sucker rod guide upon said sucker rod.

8. The sucker rod guide installation device of claim 1, wherein said device comprises an open frame configured for closing through use of a safety arm, said safety arm configured to be locked in a closed position through use of a latch.

9. The sucker rod guide installation device of claim 1, wherein said device comprises a wellhead coupler for coupling the sucker rod guide installation device onto a wellhead.

10. The sucker rod guide installer of claim 9, further comprising a wellhead attachment for threadably mounting said sucker rod guide installer directly to a wellhead.

11. The sucker rod guide installer of claim 10, wherein said wellhead attachment is slidably attached to said sucker rod guide installer and then bolted for additional support.

12. The sucker rod guide installer of claim 11, wherein said wellhead attachment further comprises a hinged plate cover pivotally connected to said wellhead attachment for guiding a sucker rod and for improved safety.

13. A sucker rod guide installation device for installing a sucker rod guide on a sucker rod, said device comprising:

a rod positioner for positioning said sucker rod, said rod positioner comprising a rod guide for guiding a portion of said rod into said sucker rod guide, wherein said rod positioner further comprises a pair of opposing, spaced, generally parallel flanges, said flanges cooperating to guide said sucker rod into said sucker rod guide; and a sucker rod guide holder, said sucker rod guide holder for holding said sucker rod guide while said rod positioner guides said sucker rod portion therein, said sucker rod guide holder comprising at least one releasable attachment for holding said sucker rod guide attached to said sucker rod guide holder during the installation process.

14. The sucker rod guide installation device of claim 13, wherein said flanges are spaced apart wider than the axial length of said sucker rod guide so that the sucker rod guide can be received between said flanges as said sucker rod is inserted into said sucker rod guide, wherein said rod positioner further comprises a hydraulic ram for driving said sucker rod into said sucker rod guide, wherein said device further comprises a pressure gauge for monitoring hydraulic pressure exerted by said hydraulic ram, said monitored hydraulic pressure providing feedback to a user as to the force necessary to install said sucker rod guide upon said sucker rod.

15. The sucker rod guide installation device of claim 13, wherein said at least one releasable attachment is adjustable for allowing the use of various sizes of sucker rod guides therein, wherein said at least one releasable attachment comprises at least one adjustable protrusion able to be adjusted based upon the size of the sucker rod guide, wherein said adjustable protrusion comprises a plurality of spring loaded fasteners that both hold said sucker rod guide and allow said sucker rod guide to be released from said sucker rod guide holder when said sucker rod guide is forcibly attached to said sucker rod.

16. A method of using a sucker rod guide installer to install a rod guide on a sucker rod comprising:

moving said rod guide installer into position;

adjusting a rod guide cradle to hold a rod guide;

placing said rod guide within said rod guide cradle;

opening a safety arm allowing a sucker rod to be passed within a frame of said sucker rod guide installer;

positioning said rod guide against said rod guide cradle; and driving said sucker rod and said rod guide cradle against said rod guide until said rod guide snaps into position around said sucker rod.

17. The method of using a sucker rod guide installer of claim 16, wherein said positioning further comprises mounting said sucker rod guide installer to a wellhead threadably.

18. The method of using a sucker rod guide installer of claim 16, wherein said positioning further comprises using a crane and a clevis attached to said sucker rod guide installer to move said sucker rod guide installer in and out of position.

19. The method of using a sucker rod guide installer of claim 16, wherein said driving said sucker rod and said rod guide cradle against said rod guide further comprises driving a plurality of rod guides against said sucker rod using a plurality of rod guide cradles.

20. A sucker rod guide installation device for installing a sucker rod guide on a sucker rod, said device comprising:

a rod positioner for positioning said sucker rod, said rod positioner comprising a rod positioner rod guide for guiding a portion of said rod into said sucker rod guide, wherein said rod positioner further comprises a pair of opposing, spaced, generally parallel flanges, said flanges cooperating to guide said sucker rod into said sucker rod guide; and a sucker rod guide holder, said sucker rod guide holder for holding said sucker rod guide while said rod positioner guides said sucker rod portion therein, said sucker rod guide holder comprising at least one releasable attachment for holding said sucker rod guide attached to said sucker rod guide holder during the installation process.

21. The sucker rod guide installation device of claim 20, wherein said flanges are spaced apart wider than the axial length of said sucker rod guide so that the sucker rod guide can be received between said flanges as said sucker rod is inserted into said sucker rod guide.

22. A sucker rod guide installation device for installing a sucker rod guide on a sucker rod, said device comprising:

a rod positioner for positioning said sucker rod, said rod positioner comprising a rod positioner rod guide for guiding a portion of said rod into said sucker rod guide, wherein said rod positioner further comprises a hydraulic ram for driving said sucker rod into said sucker rod guide;

a pressure gauge for monitoring hydraulic pressure exerted by said hydraulic ram, said monitored hydraulic pressure providing feedback to a user as to the force necessary to install said sucker rod guide upon said sucker rod; and a sucker rod guide holder, said sucker rod guide holder for holding said sucker rod guide while said rod positioner guides said sucker rod portion therein, said sucker rod guide holder comprising at least one releasable attachment for holding said sucker rod guide attached to said sucker rod guide holder during the installation process.

23. A sucker rod guide installation device for installing a sucker rod guide on a sucker rod, said device comprising:

a rod positioner for positioning said sucker rod, said rod positioner comprising a rod positioner rod guide for guiding a portion of said rod into said sucker rod guide;

a sucker rod guide holder, said sucker rod guide holder for holding said sucker rod guide while said rod positioner guides said sucker rod portion therein, said sucker rod guide holder comprising at least one releasable attachment for holding said sucker rod guide attached to said sucker rod guide holder during the installation process; and an open frame configured for closing through use of a safety arm, said safety arm configured to be locked in a closed position through use of a latch.

24. A sucker rod guide installation device for installing a sucker rod guide on a sucker rod, said device comprising:

a rod positioner for positioning said sucker rod, said rod positioner comprising a rod positioner rod guide for guiding a portion of said rod into said sucker rod guide; and a sucker rod guide holder, said sucker rod guide holder for holding said sucker rod guide while said rod positioner guides said sucker rod portion therein, said sucker rod guide holder comprising at least one releasable attachment for holding said sucker rod guide attached to said sucker rod guide holder during the installation process; and a wellhead coupler for coupling the sucker rod guide installation device onto a wellhead.

* * * * *